US007412178B2

(12) United States Patent
Karasawa

(10) Patent No.: US 7,412,178 B2
(45) Date of Patent: Aug. 12, 2008

(54) IMAGE-FORMING DEVICE

(75) Inventor: Minoru Karasawa, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 345 days.

(21) Appl. No.: 11/373,259

(22) Filed: Mar. 13, 2006

(65) Prior Publication Data

US 2006/0204260 A1 Sep. 14, 2006

(30) Foreign Application Priority Data

Mar. 11, 2005 (JP) ..... 2005-069512

(51) Int. Cl.
*G03G 15/00* (2006.01)

(52) U.S. Cl. ..... 399/49

(58) Field of Classification Search ..... 399/49, 399/72, 60

See application file for complete search history.

(56) References Cited

U.S. PATENT DOCUMENTS 4,870,460 A 9/1989 Harada et al.
5,946,523 A * 8/1999 Fujioka et al. ..... 399/49
6,246,844 B1 * 6/2001 Shiba ..... 399/49
7,200,346 B2 * 4/2007 Chigira ..... 399/49
2003/0147661 A1 * 8/2003 Ogata ..... 399/60

FOREIGN PATENT DOCUMENTS

| | | |
|---|---|---|
| JP | 7140769 | 6/1995 |
| JP | 2532073 | 6/1996 |
| JP | 10171185 | 6/1998 |
| JP | 2003211732 | 7/2003 |

* cited by examiner

*Primary Examiner*—Susan S Lee
(74) *Attorney, Agent, or Firm*—Baker Botts L.L.P.

(57) ABSTRACT

An image-forming device includes an image forming unit, a patch forming unit, a monitor, a measuring unit and a correcting unit. The image forming unit provides an electrostatic latent image formed on a surface of a photosensitive drum with charged developer to form a developer image based on an image forming condition, and transfers the developer image to an recording medium to form an image. The patch forming unit controls the image forming unit to form a patch with the developer. The monitor monitors an operating state of the image forming unit after one patch is formed before next patch is formed. The measuring unit measures density of the patch. The determining unit determines a correcting amount used to correct the image forming condition, based on the measured density of the patch. The correcting unit corrects the image forming condition based on both the correcting amount and the operating state.

17 Claims, 7 Drawing Sheets

IMAGE-FORMING DEVICE

BACKGROUND OF THE INVENTION

This application claims priority from Japanese Patent Application No. 2005-069512, filed Mar. 11, 2005, the entire subject matter of which is incorporated herein by reference.

1. Field of the Invention

The present invention relates to an image-forming device capable of forming an image with proper density at constant.

2. Description of Related Art

In conventional image-forming devices, an electrostatic latent image is formed on the surface of a photoconductor, and thereafter, a developer is applied to the surface of the photoconductor to form a developer image. The developer image is transferred to a recording medium to form an image. Since the developer deteriorates due to aging, density of an image developed with a new developer differs from density of an image developed with an aged developer. Therefore, in conventional image-forming devices, density correction is performed to adjust properly density of images to be formed.

Japanese Patent Publication No. 2532073 provides a known method of density correction. In Japanese Patent Publication No. 2532073, at first, a patch is formed on a conveyer belt which conveys recording medium for every predetermined times of image formation. Then, density of the patch formed is measured by a sensor. Corresponding to a difference between the density of the formed patch and preset target density, a correction amount is determined.

Normally, as a developer deteriorates in accordance with increase in number of times of image formation, the developer becomes charged less. Therefore, if development is carried out at an equal developing bias voltage, the amount of developer sticking on the surface of the photoconductor increases gradually, causing rising of density of formed images. In particular, this phenomenon is conspicuous when positively charged polymerized toner is used as the developer.

However, in the method described in the above patent publication, deterioration of a developer due to increase in the number of times of image formation is not considered. Therefore, even if a correction amount is once determined, the difference between density of a formed patch and preset target density increases as the developer deteriorates in accordance with increase in the number of times of image formation.

SUMMARY

In view of the above-described drawbacks, it is an objective of one aspect of the present invention to provide an image-forming device capable of forming images having proper density at constant by accurately obtaining a correction amount of image density in forming an image.

In order to attain the above and other objects, one aspect of the present invention provides an image-forming device includes an image forming unit, a patch forming unit, a monitor, a measuring unit and a correcting unit. The image forming unit provides an electrostatic latent image formed on a surface of a photosensitive drum with charged developer to form a developer image based on an image forming condition, and transfers the developer image to an recording medium to form an image. The patch forming unit controls the image forming unit to form a patch with the developer. The monitor monitors an operating state of the image forming unit after one patch is formed before next patch is formed. The measuring unit measures density of the patch. The determining unit determines a correcting amount used to correct the image forming condition, based on the measured density of the patch. The correcting unit corrects the image forming condition based on both the correcting amount and the operating state.

Another aspect of the present invention provides an image-forming device includes An image-forming device includes an image forming unit, a patch forming unit, a monitor, a measuring unit and a correcting unit. The image forming unit provides an electrostatic latent image formed on a surface of a photosensitive drum with charged developer to form a developer image based on an image forming condition, and transfers the developer image to an recording medium to form an image. The patch forming unit controls the image forming unit to form a patch with the developer. The monitor monitors an operating state of the image forming unit after one patch is formed before next patch is formed. The measuring unit measures density of the patch. The determining unit determines a correcting amount used to correct the image forming condition, based on the measured density of the patch. The correcting unit corrects the image forming condition based on the correcting amount, and further corrects the corrected image forming condition based on the moving state.

Another aspect of the present invention provides an image-forming device includes an image forming unit, a patch forming unit, a monitor, a measuring unit, a first correcting unit and a second correcting unit. The image forming unit provides an electrostatic latent image formed on a surface of a photosensitive drum with charged developer to form a developer image based on an image forming condition, and transfers the developer image to an recording medium to form an image. The patch forming unit controls the image forming unit to form a patch with the developer. The monitor monitors an operating state of the image forming unit after one patch is formed before next patch is formed. The measuring unit measures density of the patch. The determining unit determines a correcting amount used to correct the image forming condition, based on the measured density of the patch. The first correcting unit corrects the image forming condition based on the correcting amount. The second correcting unit corrects the image forming condition based on the operating state.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
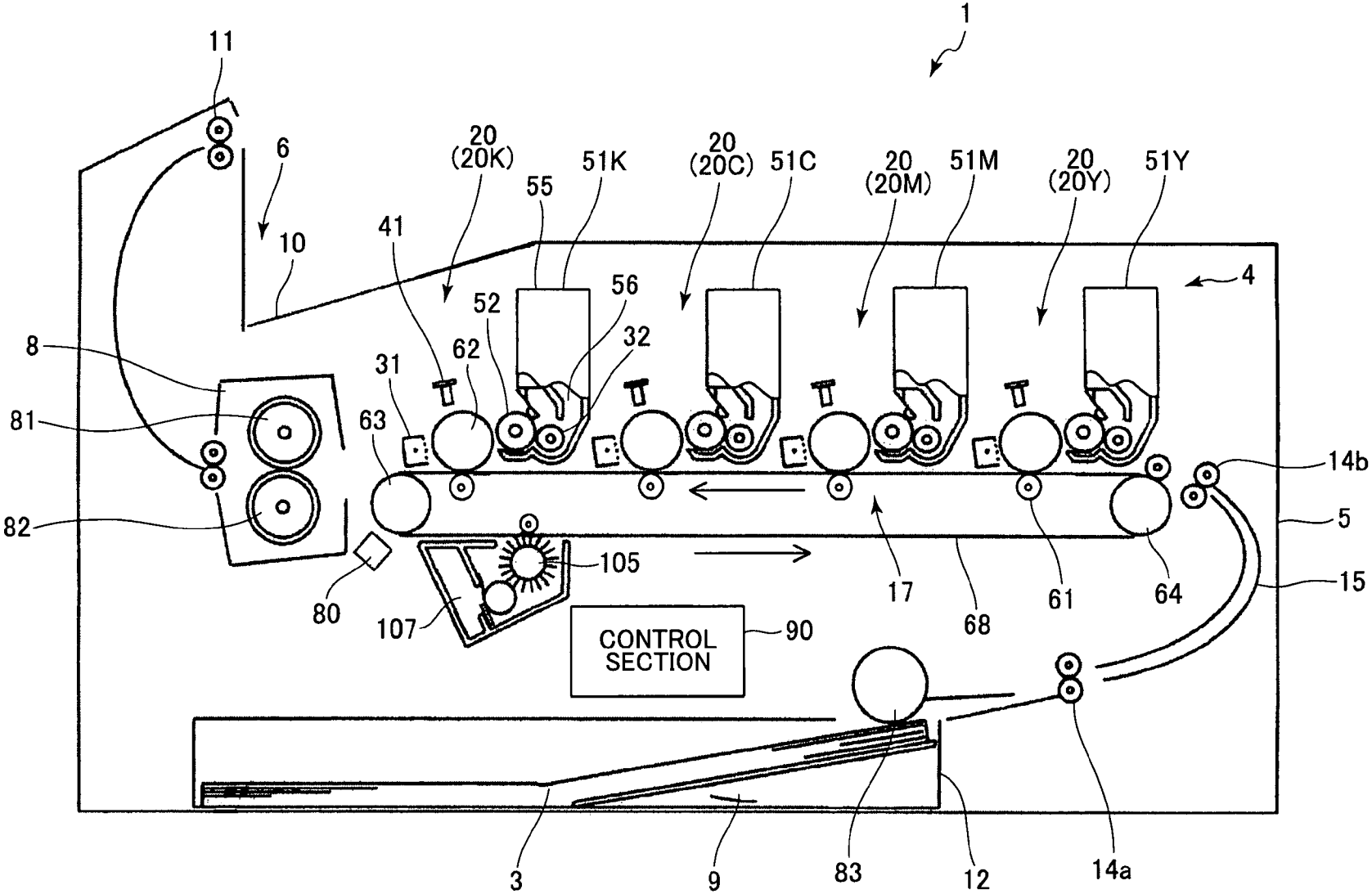
FIG. 1 is an explanatory view showing a schematic structure of a color electrophotographic printer 1 according to a direct tandem method in the first embodiment.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

FIG. 1 is a cross-sectional view showing a schematic structure of a color electrophotographic printer 1 as the image-forming device.

As shown in FIG. 1, the color electrophotographic printer 1 is a tandem color electrophotographic printer in which four image forming units 20 are arranged in a horizontal direction. The color electrophotographic printer 1 includes a paper feed section 9, an image forming section 4, a paper discharge section 6, and a control section 90. The paper feed section 9 serves to feed a recording sheet 3. The image forming section 4 serves to form an image on the recording sheet 3 fed by the paper feed section 9. The paper discharge section 6 serves to discharge the recording sheet 3 on which an image has been formed. The control section 90 serves to control operation of the color electrophotographic printer 1.

The paper feed section 9 is provided at the bottom of the body casing 5 and has a paper feed tray 12, a paper feed roller 83, and conveyer rollers 14*a* and 14*b*. The paper feed tray 12 is detachably attached from the front side (the right side in FIG. 1) of the casing 5. The paper feed roller 83 is provided above an end portion of the paper feed tray 12 (at an upper front side). The conveyer rollers 14*a* and 14*b* are provided in the downstream side relative to the paper feed roller 83 in the conveying direction of the recording sheet 3. In the following, the downstream side in the conveying direction of the recording sheet 3 will be simply called the downstream side in the conveying direction, as well as the upstream side in the conveying direction of the recording sheet 3 the upstream side in the conveying direction.

Recording sheets 3 are stacked in the paper feed tray 12. In the order from the uppermost recording sheet 3, the recording sheets 3 are fed one after another toward the conveyer rollers 14*a* and 14*b* by the rotation of the paper feed roller 83.

A guide member 15 is provided between the conveyer rollers 14*a* and 14*b*. Recording sheets 3 fed by the paper feed roller 83 are sequentially conveyed to a transfer position opposed to a photosensitive drum 62 by the conveyer roller 14*a*, guide member 15, and conveyer roller 14*b*.

The image forming section 4 is provided at a middle portion in the body casing 5, and has four image forming units 20Y, 20M, 20C, and 20K, a transfer section 17, and a fixing section 8. The image forming units 20Y, 20M, 20C, and 20K serve to form images. The transfer section 17 serves to transfer images formed respectively by the image forming units 20 to a recording sheet 3. The fixing section 8 heats/presses the images transferred to the recording sheet 3, to fix the images.

Each of the image forming units 20 has a photosensitive drum 62, an electrification charger 31, an exposure unit 41, and a developing unit 51.

The electrification charger 31 is, for example, a scorotron type charger for positive electrification which causes an electrification wire made of tungsten or the like to perform corona discharging. The electrification charger 31 electrostatically charges the surface of the photosensitive drum 62 uniformly to positive polarity.

The exposure unit 41 is constituted by an LED array and the like and generates light to form an electrostatic latent image on the surface of the photosensitive drum 62. The exposure unit 41 need not always be an LED array but may be an exposure/scanning unit (e.g., a laser scanner) that exposes the photosensitive drum 62 by scanning the drum with a laser beam.

The developing unit 51 provides the photosensitive drum 62 with a developer to form a developer image on the photosensitive drum 62. The developing unit 51 includes a developer hopper 56 as a developer container section, a supply roller 32, and a developing roller 52, in a developing casing 55.

The developer hopper 56 is an inner space in the developing casing 55. The developer hopper 56 contains developers (each of which is, for example, a polymerized toner consisting of one single non-magnetic component of positive electrification) in colors of yellow (Y), magenta (M), cyan (C), and black (K) respectively for the image forming units 20.

That is, the four image forming units 20 described above are constituted by: the image forming unit 20Y in which a yellow (Y) developer is contained in a developer hopper 56; the image forming unit 20M in which a magenta (M) developer is contained in a developer hopper 56; the image forming unit 20C in which a cyan (C) developer is contained in a developer hopper 56; and the image forming unit 20K in which a black (K) developer is contained in a developer hopper 56. These four image forming units 20 have the same structure except the colors. (Several reference symbols are omitted from FIG. 1.)

The supply roller 32 is provided in the lower side of the developer hopper 56 and has a conductive sponge member covering a roller shaft made of metal. The supply roller 32 is disposed so as to be opposed to and contact the developing roller 52, and rotatabe in a direction opposite to the rotatable direction of the developing roller 52.

The developing roller 52 is rotatably provided in a lateral side of the supply roller 32, such that the developing roller 52 is opposed to and contact the supply roller 32. The developing roller 52 has a roller portion made of an elastic member such as a conductive rubber material and covering a roller shaft made of metal. As will be described later, a predetermined developing bias voltage is applied to the developing roller 52 from a power supply 110.

The transfer section 17 is provided in the body casing 5 and opposed to the photosensitive drum 62. The transfer section 17 has a conveyer belt drive roller 63, a conveyer belt driven roller 64, a conveyer belt 68 as an endless belt, and transfer rollers 61.

The conveyer belt drive roller 63 is provided in the downstream side (rear side) of the photosensitive drum 62 of the black image forming unit 20K which is positioned in the most downstream side in the conveying direction, and also provided in the upstream side (front side) of the fixing section 8. The conveyer belt driven roller 64 is provided in the upstream side (front side) of the photosensitive drum 62 of the yellow image forming unit 20Y which is positioned in the most upstream side in the conveying direction, and also in the upper front side of the paper feed roller 83.

The conveyer belt 68 is wound around the conveyer belt drive roller 63 and the conveyer belt driven roller 64. The conveyer belt 68 is provided such that the outer surface is opposed to and contacts all the photosensitive drums 62 of the image forming units 20. When the conveyer belt drive roller 63 is driven, the conveyer belt driven roller 64 follows in the anti-clockwise direction.

The transfer rollers 61 are provided inside the wound conveyer belt 68, and opposed respectively to the photosensitive drum 62 while sandwiching the conveyer belt 68 therebetween. The transfer rollers 61 each is formed by a roller shaft made of metal covered with a roller portion made of an elastic member such as a conductive rubber material.

The transfer rollers 61 are provided rotatably in the anticlockwise direction in accrdance with the rotation of the conveyor belt 68. At the time of transfer, a predetermined voltage subjected to constant current control by a power supply (not shown) is applied to the transfer rollers 61 to apply a proper transfer bias between the transfer rollers 61 and the photosensitive drums 62. As a result, developer images carried by the photosensitive drums 62 are transferred to a recording sheet 3.

The fixing section 8 is provided in the downstream side (rear side) of the image forming units 20 and the transfer section 17. The fixing section 8 has a heat roller 81 and a pressure roller 82. The heat roller 81 has a metal element tube having a surface on which a demolding layer is formed, and a halogen lamp provided in the heat roller 81 along the axial direction thereof for heating the surface of the heat roller 81 to a fixing temperature. The pressure roller 82 is provided to press the heat roller 81.

The paper discharge section 6 is provided in the downstream side of the fixing section 8 in the conveying direction, and at an upper portion of the body casing 5. The paper discharge section 6 has a pair of paper discharge rollers 11, and a paper discharge tray 10 provided in the downstream side of the paper discharge rollers 11. The paper discharge rollers 11 discharge recording sheets 3 to which fixing of images have been complete, to the paper discharge tray 10. The paper discharge tray 10 stocks recording sheets 3 which have completely passed all the image forming process.

A developer collector 107 is provided at the right lower side of the conveyer belt drive roller 63, to collect remaining developers (such as a patch and the like described later) sticking to the conveyer belt 68. The developer collector 107 has a developer collect roller 105. The developer collect roller 105 is provided so as to contact the outer surface of the conveyer belt 68.

Figure 2:
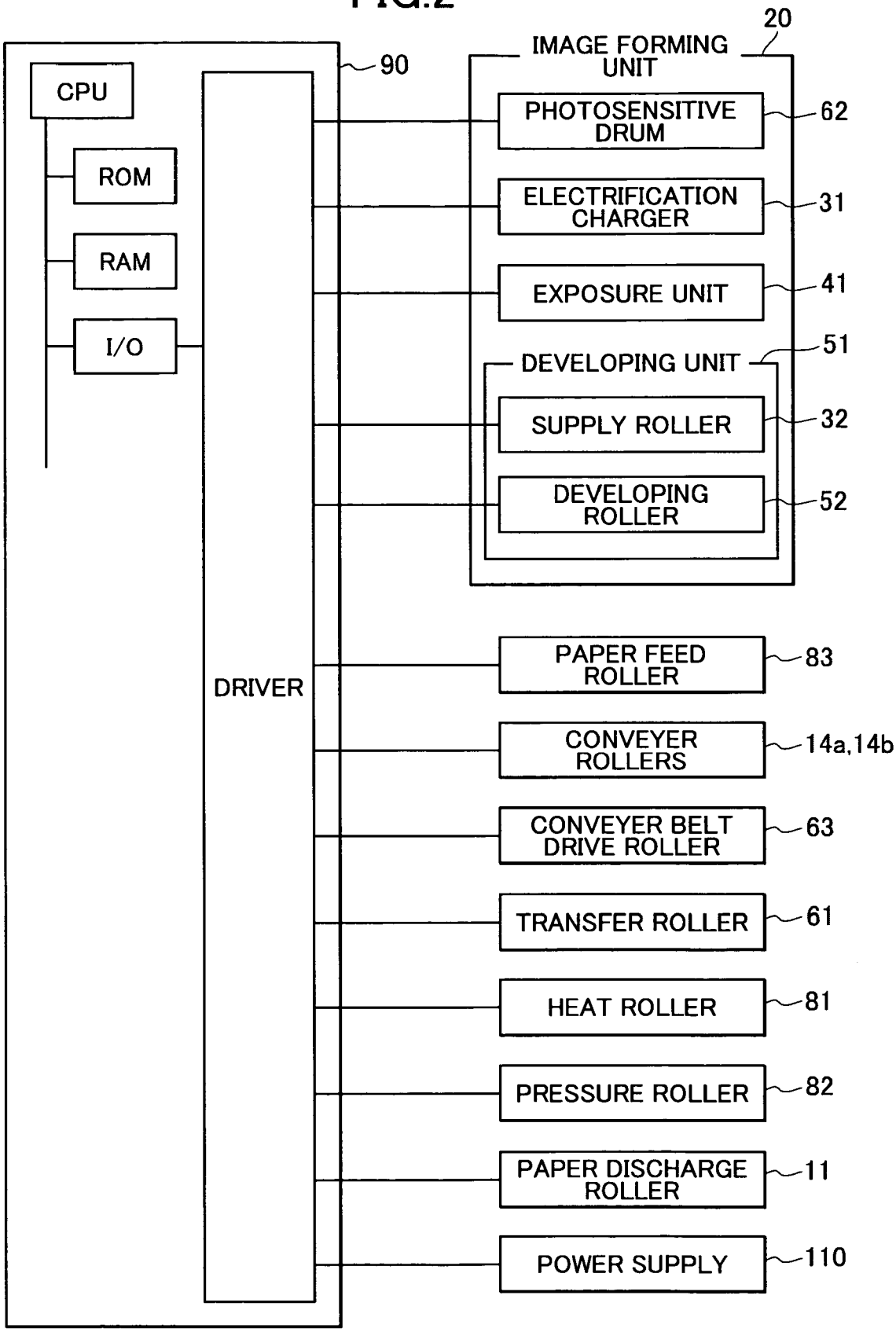
FIG. 2 is a block diagram schematically showing an electric structure of the color electrophotographic printer 1.

Next, electric structure of the color electrophotographic printer 1 and a process through which the color electrophotographic printer 1 forms a color image on a recording sheet 3 will be described with reference to FIG. 2. FIG. 2 is a block diagram schematically showing the electric structure of the color electrophotographic printer As shown in FIG. 2, the color electrophotographic printer 1 has a control section 90 (including CPU, ROM, RAM, I/O, drivers, and the like) that performs overall control of the respective sections of the device. The control section 90 performs an image forming operation and calculates correction amount that is used to correct an image forming condition in the image forming operation.

In the normal image forming operation, the control section 90 performs initial setting of respective sections of the device that are control targets when forming an image. Thereafter, the control section 90 controls the electrification charger 31 to charge the surface of the photosensitive drum 62 uniformly electrostatically. Further, the control section 90 controls the exposure unit 41 to irradiate light in accordance with image information, causing forming an electrostatic latent image on the surface of the photosensitive drum 62. Next, the control section 90 controls the developing unit 51 to provide the surface of the photosensitive drum 62 with the developer, causing visualizing the electrostatic latent image on the surface of the photosensitive drum 62. Then, the control section 90 drives photosensitive drum 62 to transfer the visualized image (developer image) to the transfer position.

The control section 90 also drives the paper feed roller 83 and the conveyer rollers 14a and 14b to feed a recording sheet 3 to the transfer position on the conveyer belt 68. At the transfer position, the control section 90 applies a transfer bias between the transfer roller 61 and the photosensitive drum 62, to transfer the visualized image to the recording sheet 3.

Next, the control section 90 drives the paper feed roller 83 and the conveyer rollers 14*a* and 14*b* to convey the recording sheet 3 to the fixing section 8. At the fixing section 8, the control section 90 controls the heat roller 81 and the pressure roller 82 to pinch and convey the recording sheet 3. Accordingly, the visualized image (developer image) on the recording sheet 3 is heated and pressed to be fixed to the recording sheet 3. Further, the control section 90 drives the paper discharge rollers 11 to discharge the recording sheet 3 onto the paper discharge tray 10. Then, image forming operation is terminated.

Through the image forming operation as described above, the color electrophotographic printer 1 forms an image on the recording sheet 3. However, in the type of color electrophotographic printer which uses a developer to form an image, such as the color electrophotographic printer 1, the developer deteriorates as the number of times of image formation increases. As a result, the density of images formed on the recording sheets 3 changes gradually as the number of times of the image formation increases.

More specifically, if the developer deteriorates, electrification ability of the developer weakens (or lowers) The surface of the photosensitive drum 62 and the developer are both electrostatically charged positively. The potential of the developer is smaller than the potential of the photosensitive drum 62. The more the potential difference between both increases, the more the developer sticks to the surface of the photosensitive drum 62. Therefore, the more electrification ability of the developer weakens, the more the developer sticks to the surface of the photosensitive drum 62.

In conclusion, if images are continuously formed with a constant developing bias voltage applied to the developing roller 52, the amount of the developer which moves from the developing roller 52 and sticks to the photosensitive drum 62 increases. Accordingly, the density of images formed on the recording sheets 3 gradually becomes higher. To prevent this density change of image, the color electrophotographic printer 1 corrects the developing bias voltage. The correction of the developing bias voltage will be described below.

Figure 3:
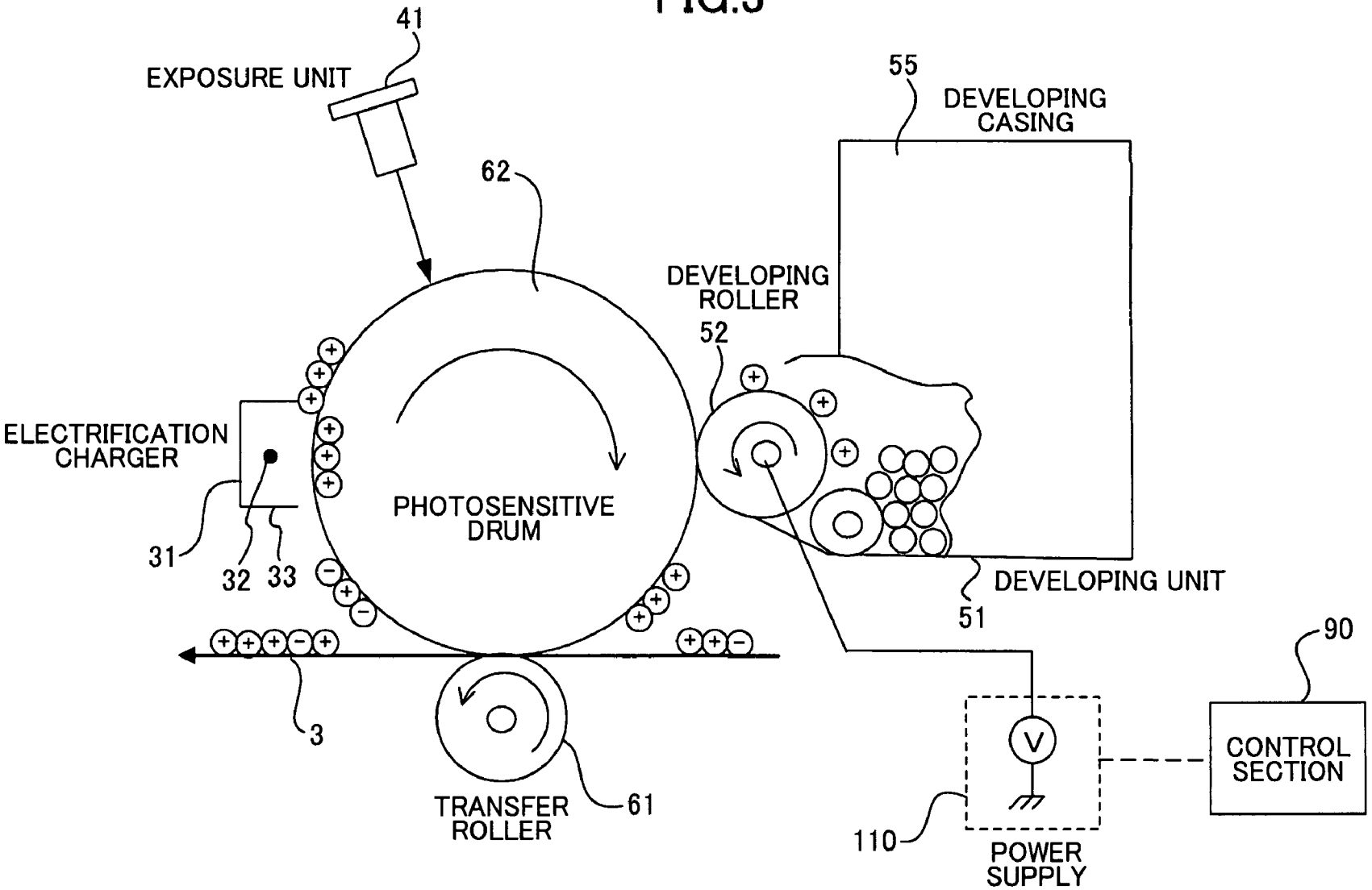
FIG. 3 is a schematic view of a part concerning formation of a developer image in an image forming unit.
Figure 4:
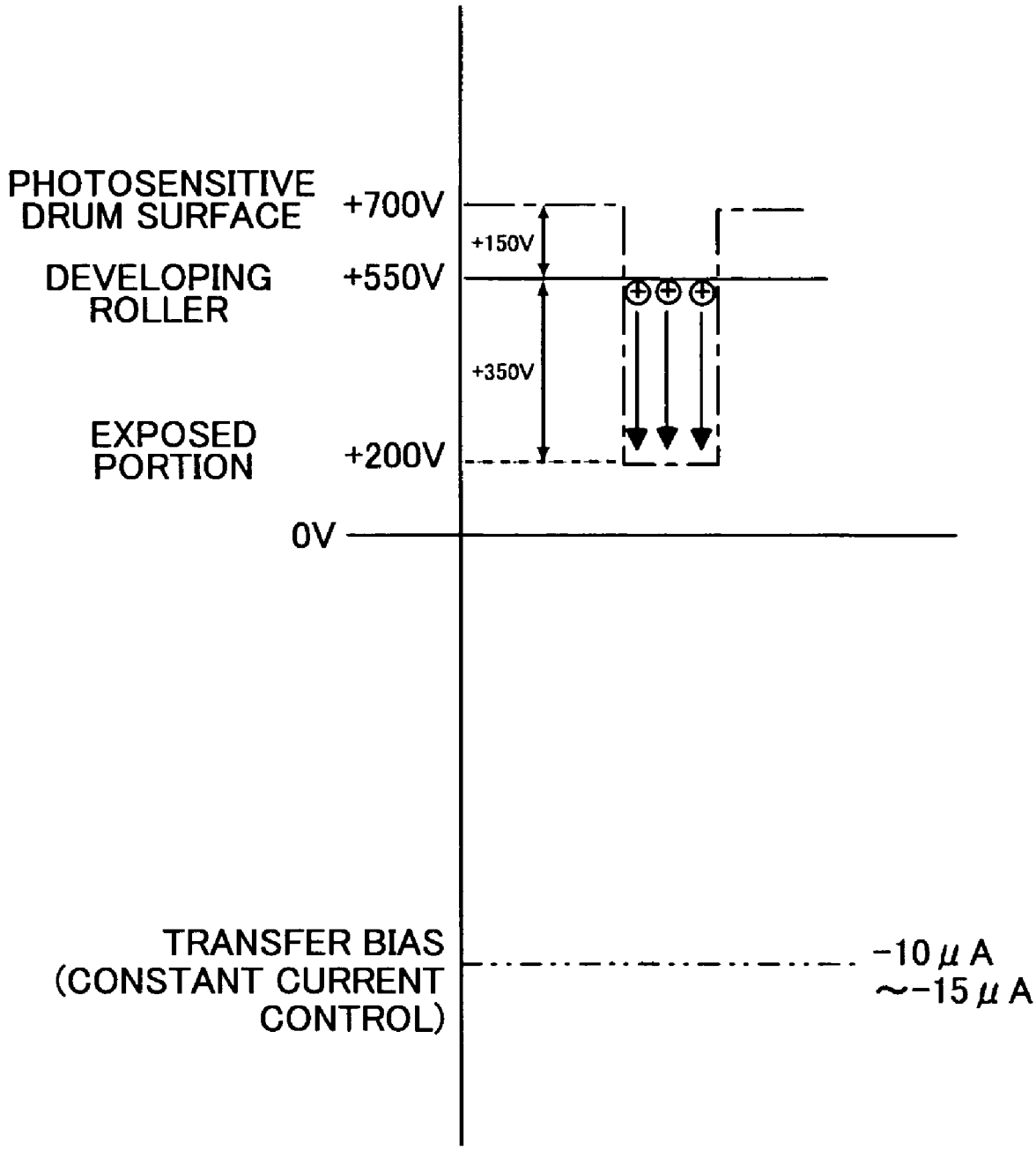
FIG. 4 is an explanatory view showing a relationship between potential differences of a developing unit and a photosensitive drum.
Figure 5:
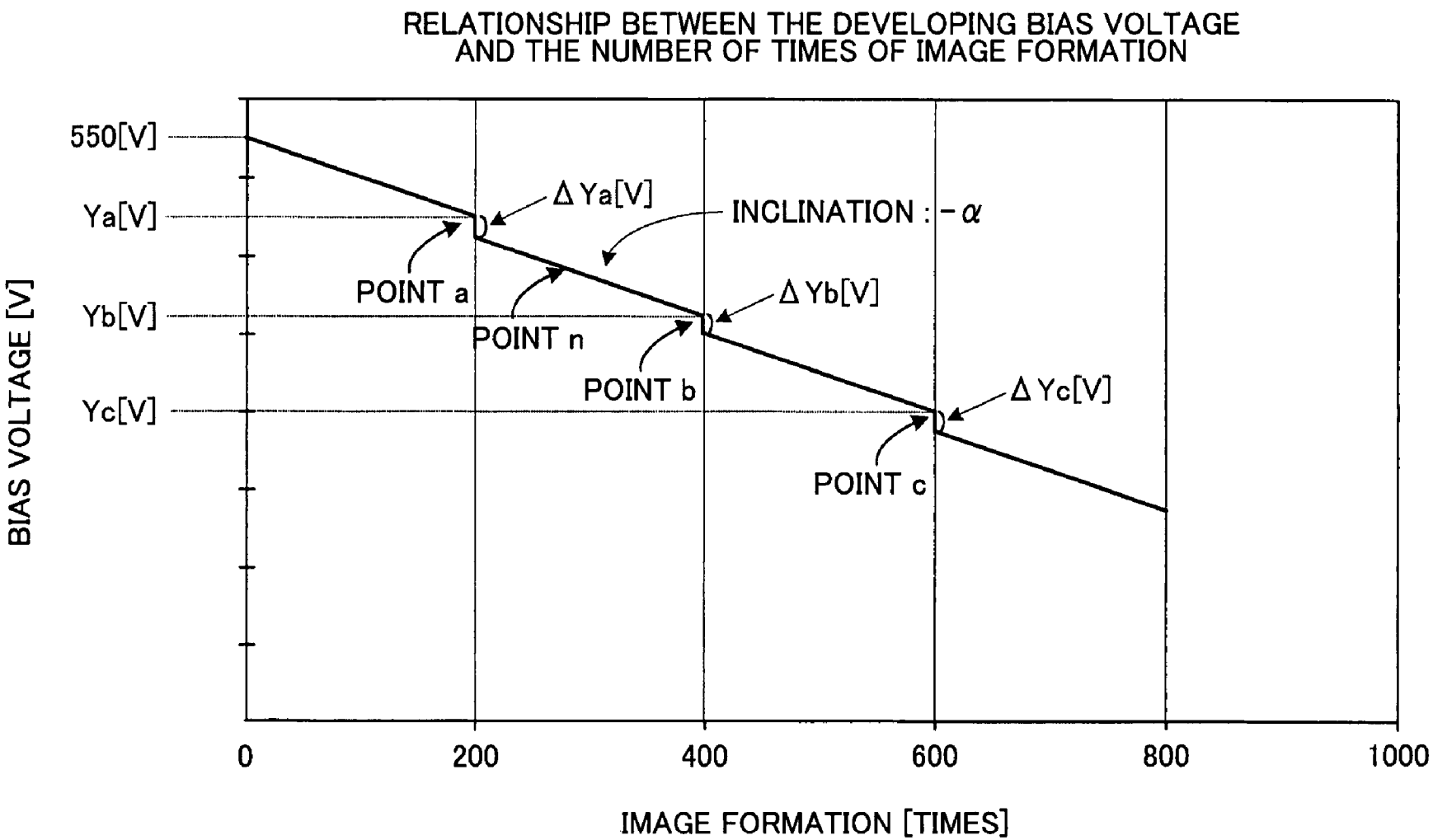
FIG. 5 is a graph showing a relationship between the number of times of image formation and a corrected developing bias voltage.

FIG. 3 is a schematic view showing the vicinity of a photosensitive drum 62. FIG. 4 is an explanatory graph for a developing bias voltage and the like applied to the developing roller 52. FIG. 5 is a graph showing a relationship between the number of times of image formation and a corrected developing bias voltage.

As shown in FIG. 3, the electrification charger 31 is provided in the left side of the photosensitive drum 62, and the exposure unit 41 is provided left-obliquely above the photosensitive drum 62. The developing unit 51 is provided in the right side of the photosensitive drum 62. The transfer roller 61 is provided below the photosensitive drum 62, while sandwiching the conveyer belt 68 therebetween.

When the image formation starts, the photosensitive drum 62 rotates in the clockwise direction. During this rotation, the surface of the photosensitive drum 62 is electrostatically charged uniformly to a predetermined voltage (+700V in the present embodiment) by the electrification charger 31. Next, light is irradiated on the surface of the photosensitive drum 62 from an exposure unit 41 based on image data, in order to form an electrostatic latent image on the surface of the photosensitive drum 62, the electrostatic latent image having a lower potential portion than portions not irradiated with light. Subsequently, a developing bias voltage is applied to the developing roller 52 from a power source 110. Due to the developing bias voltage, the developer moves and sticks to the surface of the photosensitive drum 62 from the developing roller 52. FIG. 4 shows a relationship of the potential difference between the photosensitive drum 62 and the developing roller 52 at this time.

As shown in FIG. 4, firstly the surface of the photosensitive drum 62 is uniformly electrostatically charged to the potential of +700V. When the surface of the photosensitive drum 62 is charged by the exposure unit 41, the potential of the exposed portion drops to +200V. Therefore, if the developing bias voltage applied to the developing roller 52 is +550V, the potential difference between the developing roller 52 and exposed portions of the surface of the photosensitive drum 62 is 350V, and the potential difference between the developing roller 52 and non-exposed portions of the surface of the photosensitive drum 62 is 150V. As a result, the developer of the surface of the developing roller 52 sticks to the exposed portions of the surface of the photosensitive drum 62 which have larger potential difference with the surface of the developing roller 52 than non-exposed portions of the surface of the photosensitive drum 62.

Thus, the amount of the developer sticking to the surface of the photosensitive drum 62, that is, the density of the image to be formed varies based on the size of the developing bias voltage applied to the developing roller 52. Suppose now that electrification ability (performance) of the developer is constant. Then, if the developing bias voltage is raised, the amount of the developer which sticks to the surface of the photosensitive drum 62 from the developing roller 52 increases, so that the density of the image becomes high. Otherwise, if the developing bias voltage is lowered, the amount of the developer which sticks to the surface of the photosensitive drum 62 decreases, so that the density of the image becomes low.

Normally, new developer has high electrification ability. In such case, even if the developing bias voltage is high, the density of images formed is low because the amount of the new developer which sticks to the photosensitive drum 62 is small. However, as the number of times of image formation increases, the electrification ability of the developer weakens. When a predetermined developing bias voltage is applied continuously, the amount of the developer which sticks to the surface of the photosensitive drum 62 increases, and the density of images becomes high. In other words, if the developing bias voltage is constant, the color of image formed on the recording sheet 3 becomes deeper as the number of times of image formation increases.

Hence, the color electrophotographic printer 1 according to the first embodiment is configured to suppress such changes in image density by correcting the developing bias voltage every time when images are formed a predetermined number of times (e.g., once or plural times) by the image forming units 20.

A method of correcting the developing bias voltage will be described according to FIG. 5. FIG. 5 shows the developing bias voltage relative to the number of times of image formation. In FIG. 5, the horizontal axis represents the number of times of image formation while the vertical axis represents the developing bias voltage.

In the color electrophotographic printer 1, a patch (e.g., a pattern image for adjusting density) is periodically formed (at points "a", "b", and "c" in FIG. 5). Note that correcting of the developing bias voltage performed between the points "a" and "b" will be described herewith, for example. A first patch (at the point "a" in FIG. 5) is formed with a developing bias voltage of Ya [V]. The density of the patch is measured by a density sensor 80. Further, a difference between the measured density and a predetermined target density is calculated, and a correction amount ΔYa [V] for the developing bias voltage is determined in order to make the difference zero.

After the first patch has been formed until a second patch (at the point "b" in FIG. 5) is formed, the developing bias voltage is reduced from Ya−ΔYa by a predetermined amount every time image formation is carried out a predetermined number of times. An inclination α that indicates a reduction in the developing bias voltage relative to the number of times of the image formation is used for calculating the correction amount. Therefore, a developing bias voltage Yn that should be obtained at a normal image formation time point (e.g., the point "n") can be expressed as $Yn=Ya-\Delta Ya-\alpha\times n$ [V] (where "n" is the number of times of the normal image formation counted from the point "a").

The second patch (at the point "b") is formed with a developing bias voltage $Yb\ [V]=Ya-\Delta Ya-\alpha\times N$ [V], which is obtained by reducing a product of the inclination α and the number N of times of image formation, from a reference value Ya−ΔYa[V] obtained at the formation of the first patch. The number N of times of image formation carried out from the formation of the first patch (at the point "a") to the formation of the second patch (at the point "b") is 200 in the present embodiment. A correction amount ΔYb [V] for the developing bias voltage is obtained in a similar manner to the case of the first patch (at the point "a").

In this way, the color electrophotographic printer 1 according to the present embodiment forms a patch periodically (for every 200 times of image formation) and calculates a correction amount for the developing bias voltage based on the density of the patch. Further, between the formation the of patches (for example, between the points "a" and "b"), the image formation is carried out while reducing the developing bias voltage based on the inclination α for every predetermined number (one or a plurality) of times of the image formation.

The inclination a may be α constant which has been obtained in advance by experiments or the like. Alternatively, the inclination α may be calculated from the difference in density between patches, which is measured by the density sensor 80. That is, the difference between density of the patch at this time point and density of another patch formed at an immediately previous time point may be divided by the number of times (200 times) of the image formation carried out between these two time points, to obtain a value. This value may be updated every time a patch is formed.

Figure 6:
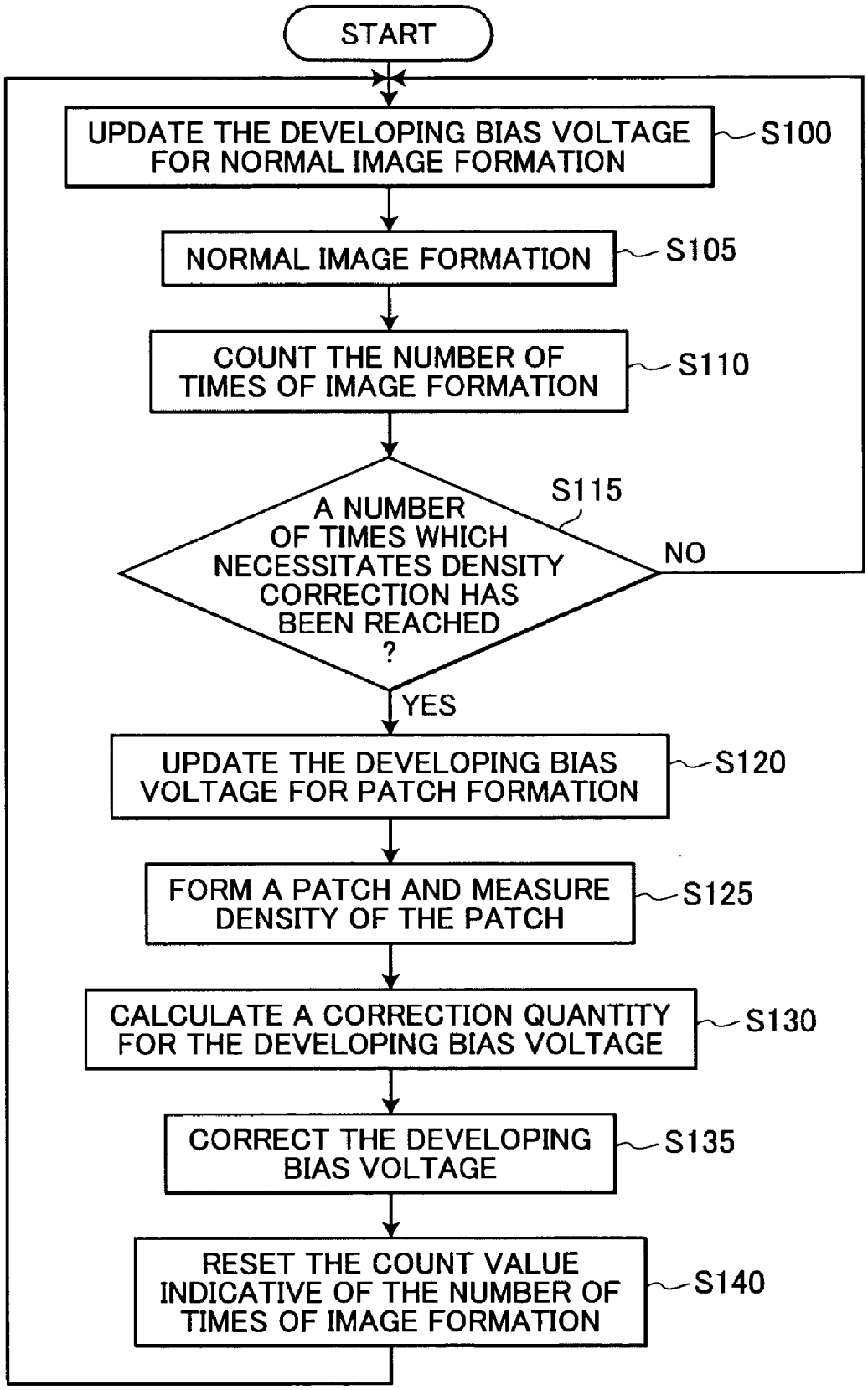
FIG. 6 is a flowchart showing a flow of processing to obtain a correction amount for a developing bias voltage, which is executed by a control section 90.

Referring to FIG. 6, a description will now be made of the flow of processing executed by the control section 90 to obtain the correction amount for the developing bias voltage as described above. Four image units each independently carries out the correction processing shown in FIG. 6, so that proper corrections are performed respectively for the four image units 20.

FIG. 6 is a flowchart of processing to obtain a correction amount for a developing bias voltage. This processing is started upon turning-ON of the power supply of the color electrophotographic printer 1. Firstly, the control section 90 updates the developing bias voltage for forming an image (S100) and forms the image (S105). Then, the control section 90 counts up the number of times of the image formation (S110).

Next, the control section 90 determines whether or not the counted number of times of image formation has reached a predetermined number of times (200 times in the present embodiment) at which the density correction should be performed (S115). If the counted number of times of the image formation has not reached the predetermined number of times of the image formation (No in step S115), the control section 90 returns to the step S100, then, updates the developing bias voltage for the image formation, and forms the image. On the other hand, if the counted number of times of the image formation has reached the predetermined number of times of the image formation (Yes in step S115), the control section 90 updates the developing bias voltage for forming a patch (S120).

As described previously, the developing bias voltage updated in the step S120 takes a value (for example, a developing bias voltage Yb [V]=Ya−ΔYa−α×N [V] in case of the point "b" in FIG. 5) which is a result of reducing the correction amount ΔYa and the value α×N as a product of the counted number N of times of image formation and a proportional constant α, from a previous developing bias voltage Ya for forming a previous patch.

After updating the developing bias voltage for forming a patch in the step S120, the control section 90 forms a patch, and measures density of the patch with the density sensor 80 (S125). This patch formation is carried out in a similar manner with the normal image formation processing. That is, the control section 90 operates the transfer roller 61, the conveyer belt drive roller 63, and the image forming unit 20 to form a developer image (of a patch) on the conveyer belt 68 in place of a recording sheet 3. In this case, however, there is no need of operating a paper feed roller 83, conveyer rollers 14*a* and 14*b*, a fixing section 8, or paper discharge rollers 11 to work because no image is formed on any recording sheet 3.

Though not shown in FIG. 6, after density of the patch is measured in the step S125, the developer on the conveyer belt 68 is collected by the developer collector 107.

Next, the control section 90 calculates a difference between the density of the patch measured in the step S125 and predetermined target density and a correction amount for the developing bias voltage which makes the difference zero (S130), and corrects the developing bias voltage based on the calculated correction amount (S135).

Finally, the control section 90 resets the count value indicative of the number of times of the image formation (S140), and returns to the step S100 from which the processing is further continued. The processing ends when the power supply of the color electrophotographic printer 1 is turned OFF.

Thus, each patch is formed with the developing bias voltage (Y−ΔY−N×α) which is obtained by reducing a value (N×α) proportional to the number (N) of times of the image formation carried out after the previous patch is formed before the next patch is formed, from the developing bias voltage (Y−ΔY) corrected at the previous formation of the patch. Therefore, the density of the patch approximates to the target density.

Since the correction amount (ΔY) is obtained based on such a patch, the correction amount (ΔY) can be calculated accurately. As a consequence, a corrected developing bias voltage (Y−ΔY) corrected on the basis of the accurate correction amount (ΔY) takes a proper value.

Further, the developing bias voltage for the image formation takes a value (Y−ΔY−n×α) obtained by reducing the value (n×α) proportional to the number (n) of times of image formation, from the corrected developing bias voltage (Y−ΔY). That is, the developing bias voltage is reduced by an amount equivalent to increase in density caused by deterioration of the developer. This also contributes to formation of an image with proper density.

In addition, since the developing bias voltage applied in forming a patch is corrected properly, there is no need of using any excessive amount of developer. Thus, the amount of developer collected from the conveyer belt 68 when cleaning the patch formed on the conveyer belt 68 can be reduced. Further, the developing unit 51 and conveyer belt 68 or the developer collector 107 can have extended lifetime.

Figure 7:
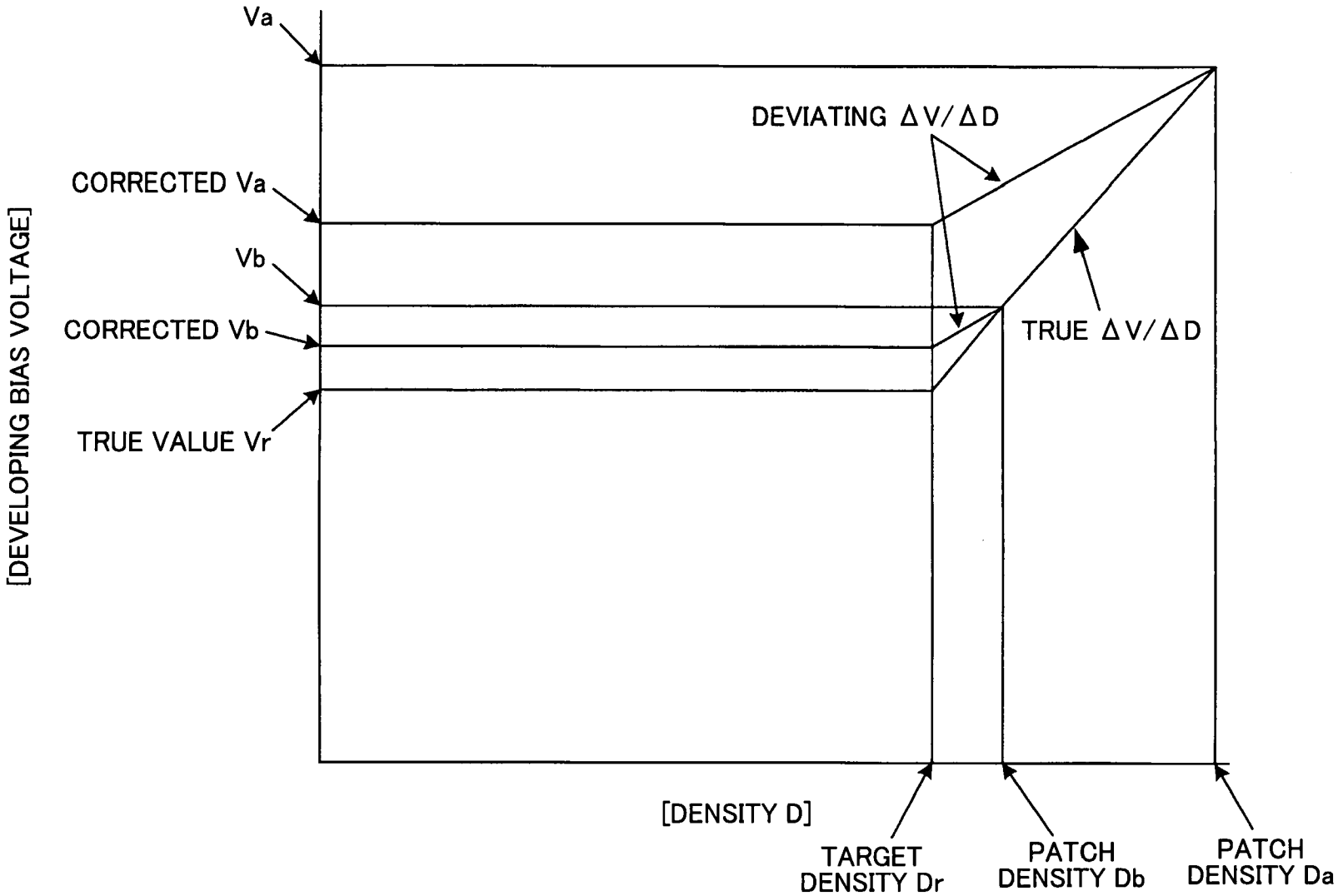
FIG. 7 is a graph showing outline of density correction processing.

FIG. 7 shows a comparison in patch density between when a developing bias voltage for forming a patch is set to a developing bias voltage Va and when a developing bias voltage for forming a patch is set to a developing bias voltage Vb close to a true developing bias voltage Vr than the developing bias voltage Va.

The correction of the developing bias voltage in forming a patch is performed herewith. The correction of the developing bias voltage is carried out by forming a patch on the conveyer belt 68 with a developing bias voltage Vt and by reading the patch density Dm by the density sensor 80.

A corrected developing bias voltage V0 is obtained by the following equation with use of a correction control parameter ΔV/ΔD which has been obtained in advance by experiments or the like and target density Dr.

$$V0=(Dr-Dm)\cdot\Delta V/\Delta D+Vt$$

If the correction control parameter ΔV/ΔD does not deviate from a true value, an aimed true developing bias voltage Vr can be obtained regardless of whether a patch is formed with the developing bias voltage Va or the developing bias voltage Vb close to the true developing bias voltage Vr. In practice, however, the correction control parameter ΔV/ΔD is difficult to be set to a true value, and an error occurs in a greater or less degree.

Since the corrected developing bias voltage V0 is proportional to the correction control parameter ΔV/ΔD, the corrected developing bias voltage V0 deviates from the true value more as the correction control parameter ΔV/ΔD deviates from the true value. That is, if the correction control parameter ΔV/ΔD deviates from the true value, the corrected developing bias voltage approximates to the true developing bias voltage Vr in the case of forming a patch with the developing bias voltage Vb close to the true developing bias voltage Vr than in the case of forming a patch with the developing bias voltage Va (which is farer from Vr than Vb), as shown in FIG. 7. In other words, correction from Da involves in a disadvantage equivalent to multiplication of an error of ΔV/ΔD by which (Da−Db) as a difference between (Dr−Da) and (Dr−Db).

Specifically, in the present embodiment, the developing bias voltage is controlled continually so as to attain the target density, and is therefore not far from the true developing bias voltage. Hence, since a patch is always formed with a developing bias voltage set immediately before patch formation operation (density correction operation), that is more advantageously than to the developing bias voltage Va farer from Vr than Vb.

While the invention has been described in detail with reference to the specific embodiment thereof, it would be apparent to those skilled in the art that various changes and modifications may be made therein without departing from the spirit of the invention.

For example, in the present embodiment, the developer is reduced by a predetermined constant amount every time the image formation is carried out. However, this amount may be determined based on the difference in density between a previous patch and a new patch and by the number of times of image formation every time a patch is formed. Then, the developing bias voltage can be corrected based on the result of forming actually an image by the image forming unit 20 although the processing may be complicated. Therefore, an image having proper density can be obtained when normal image formation is carried out.

Also the present embodiment deals with a case in which electrification ability (or electrification performance) lowers due to deterioration of the developer. However, some kinds of developers may have an opposite property to this. In this case, correction may be carried out so as to raise (increase) the developing bias voltage. Further, correction may be carried out, for example, corresponding to the number of rotations of the developing roller 52 in place of the number N of times of image formation.

In order to change density of a developer image, the potential difference between the developing roller 52 and the surface of the photosensitive drum 62 may be changed. Accordingly, in place of the developing bias voltage applied to the developing roller 52, the electrification voltage depending on the electrification charger 31 may be changed (resulting in that the potential of the surface of the photosensitive drum 62 may change). Alternatively, the intensity of exposure depending on the exposure unit 41 may be changed.

In the first embodiment, the image-forming device adopts a tandem method of a so-called horizontal type in which four image forming units 20 are arranged in a horizontal direction. However, another tandem method of a so-called vertical type in which four image forming units 20 are arranged in a vertical direction is available.

Further, the first embodiment adopts a so-called direct method according to a method in which an image is directly formed on a recording sheet 3 by each image forming unit 20. However, an intermediate transfer belt may be used, and so, a patch may be formed on the intermediate transfer belt in place of the conveyer belt 68, to obtain a correction amount for an image forming condition.

In place of using a belt like the conveyer belt 68 or the intermediate transfer belt, a transfer drum may be used. In the first embodiment, four image forming units 20 are used to obtain a color image. Needless to say, the present invention may be applied to a monochrome electrophotographic printer using only one black image forming unit.

What is claimed is:

1. An image-forming device comprising:

an image forming unit that provides an electrostatic latent image formed on a surface of a photosensitive drum with charged developer to form a developer image based on an image forming condition, and transfers the developer image to an recording medium to form an image;

a patch forming unit that controls the image forming unit to form a patch with the developer;

a monitor that monitors an operating state of the image forming unit after one patch is formed before next patch is formed;

a measuring unit that measures density of the patch;

a determining unit that determines a correcting amount used to correct the image forming condition, based on the measured density of the patch; and a correcting unit that corrects the image forming condition based on both the correcting amount and the operating state.

2. The image-forming device according to claim 1, wherein the image forming condition includes amount of the developer provided for the electrostatic latent image.

3. The image-forming device according to claim 2, wherein the determining unit determines the correcting amount such that the amount of the developer provided for the electrostatic latent image is constant.

4. The image-forming device according to claim 1, wherein the determining unit determines the correcting amount based on a difference between the measured density of the patch and a predetermined target density.

5. The image-forming device according to claim 1, wherein the determining unit determines the correcting amount so that the measured density of the patch is equal to the predetermined target density.

6. The image-forming device according to claim 1, wherein the operating state includes number of times of the image formation.

7. The image-forming device according to claim 6, wherein the correcting unit corrects the image forming condition whenever the image forming unit forms the image a predetermined number of times.

8. The image-forming device according to claim 6, wherein the correcting unit corrects the image forming condition based on a product of a predetermined coefficient and the number of times the image formation is performed.

9. The image-forming device according to claim 6, further comprising a calculating unit that calculates a coefficient based on a difference between the density of one patch and the density of another patch and the number of times of the image formation, wherein the correcting unit corrects the image forming condition based on a product of the coefficient and the number of times the image formation is performed.

10. The image-forming device according to claim 9, wherein the calculating unit calculates the coefficient whenever the patch is formed.

11. The image-forming device according to claim 1, further comprising a developing roller that provides the surface of the photosensitive drum with the charged developer while rotating, wherein the operating state includes number of times the developing roller rotates.

12. The image-forming device according to claim 1, wherein the image forming unit applies a bias voltage to the developer to transfer the developer to the electrostatic latent image, wherein the image forming condition includes the bias voltage.

13. The image-forming device according to claim 1, wherein the image forming unit applies electrification voltage to the surface of the photosensitive drum, wherein the image forming condition includes the electrification voltage.

14. The image-forming device according to claim 1, wherein the image forming unit exposes the surface of the photosensitive drum to light to form the electrostatic latent image on the surface of the photosensitive drum, wherein the image forming condition includes intensity of the exposing.

15. The image-forming device according to claim 1, wherein the image forming unit includes a plurality of image forming units, wherein the correcting unit corrects the image forming condition for each image forming unit.

16. An image-forming device comprising:

an image forming unit that provides an electrostatic latent image formed on a surface of a photosensitive drum with charged developer to form a developer image based on an image forming condition, and transfers the developer image to an recording medium to form an image;

a patch forming unit that controls the image forming unit to form a patch with the developer;

a monitor that monitors an operating state of the image forming unit after one patch is formed before next patch is formed;

a measuring unit that measures density of the patch;

a determining unit that determines a correcting amount used to correct the image forming condition, based on the measured density of the patch; and a correcting unit that corrects the image forming condition based on the correcting amount, and further corrects the corrected image forming condition based on the operating state.

17. An image-forming device comprising:

an image forming unit that provides an electrostatic latent image formed on a surface of a photosensitive drum with charged developer to form a developer image based on an image forming condition, and transfers the developer image to an recording medium to form an image;

a patch forming unit that controls the image forming unit to form a patch with the developer;

a monitor that monitors an operating state of the image forming unit after one patch is formed before next patch is formed;

a measuring unit that measures density of the patch;

a determining unit that determines a correcting amount used to correct the image forming condition, based on the measured density of the patch;

a first correcting unit that corrects the image forming condition based on the correcting amount; and a second correcting unit that corrects the image forming condition based on the operating state.

* * * * *